US005237905A

United States Patent [19]

Kuttruf

[11] Patent Number: 5,237,905

[45] Date of Patent: Aug. 24, 1993

[54] DEVICE FOR LIMITING A WORKING STROKE OF A HYDRAULIC CYLINDER

[75] Inventor: Werner Kuttruf, Wuppertal, Fed. Rep. of Germany

[73] Assignee: BW Hydraulik GmbH, Wuppertal, Fed. Rep. of Germany

[21] Appl. No.: 887,550

[22] Filed: May 21, 1992

[30] Foreign Application Priority Data

May 23, 1991 [DE] Fed. Rep. of Germany ..... 4116842

[51] Int. Cl.[5] ..... F15B 13/02

[52] U.S. Cl. ..... 91/47; 91/380; 91/389; 91/390; 91/400

[58] Field of Search ..... 91/47, 358 R, 377, 378, 91/380, 389, 390, 392, 400, 404, 405

[56] References Cited

U.S. PATENT DOCUMENTS 2,018,977 10/1935 Spellman et al. ..... 91/47
2,982,259 5/1961 Lan ..... 91/389
5,081,902 1/1992 Rausch ..... 91/47

FOREIGN PATENT DOCUMENTS 2323522 5/1973 Fed. Rep. of Germany .
2309283 9/1973 Fed. Rep. of Germany ..... 91/380

*Primary Examiner*—Edward K. Look
*Assistant Examiner*—F. Daniel Lopez
*Attorney, Agent, or Firm*—Robert W. Becker & Associates

[57] ABSTRACT

A device for limiting a working stroke of a hydraulic cylinder has a working cylinder and a working piston comprising a hollow piston rod connected to its top portion. A pressure reservoir is connected to a first working chamber for constantly supplying a pressure medium thereto, and a pressure source is connected via an inlet line to a second working chamber for supplying a pressure medium thereto. A shut-off valve comprises a push piston and a return spring for holding the push piston in its closed position. A drag link is slidably connected inside the push piston and extends through the working piston into the interior of the hollow piston rod. One end of the drag link has a first abutment that comes into contact with the working piston before the working piston reaches its end position. The other end of the drag link comprises an annular abutment which, when the first abutment is in contact, moves the push piston in the opening direction until a position of equilibrium is reached in which the working piston is hydraulically held in its end position. The shut-off valve is alternately actuatable by two actuating pistons.

9 Claims, 3 Drawing Sheets

DEVICE FOR LIMITING A WORKING STROKE OF A HYDRAULIC CYLINDER

BACKGROUND OF THE INVENTION

The present invention relates to a device for limiting a working stroke of a hydraulic cylinder, especially for pressing devices, wherein the working cylinder may be actuatable from both ends.

From German Offenlegungschrfit 23 23 522 a stroke-dependent valve device for limiting the working stroke of the piston of an auxiliary power steering device is known. When the stroke end position is reached, a short circuit between the pressure and the suction side of the pressure medium pump is generated by opening a valve. For the actuation of the valve control cams are provided that are drivingly connected with the working piston. When the prescribed stroke end position is reached, the control cams shut off a pressure force which maintains the control slide together with a spring in a non-operating position which prevents the short circuit of the pump. The constructive expenditure for the valve and the lines for shutting off the working pressure in this embodiment are relatively great in this known device.

It is therefore an object of the present invention to provide a constructively and functionally simple device for limiting the stroke of a piston of a working cylinder, which may be combined with the working cylinder to one constructive unit in a compact design, which requires only constructively simple actuating elements, and with which a hydromechanical positioning control circuit may be accomplished by simple means. Furthermore, the device should be embodied such that the stroke limitation with respect to timing and positioning of the piston may be simply adjusted within given limits.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
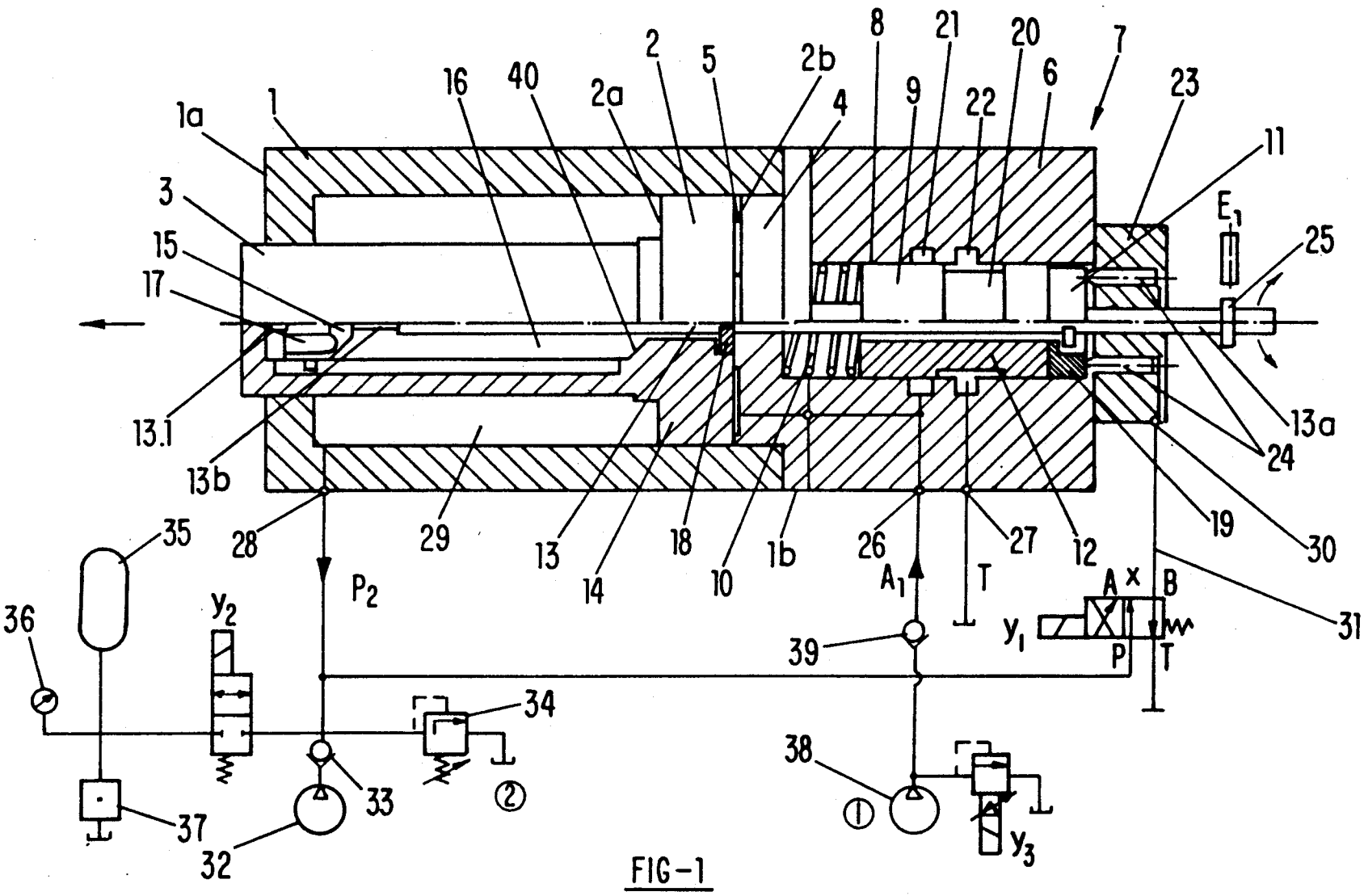
FIG. 1 shows an axial section of a hydraulic cylinder with shut-off valve in connection with the hydraulic circuit diagram whereby the working piston is in its initial resting position.

The device for limiting a working stroke of a hydraulic cylinder according to the present invention is primarily characterized by:

a working cylinder with a first and a second end and a working piston slidably connected within the working cylinder, the working piston having a top portion and a bottom portion and comprising a hollow piston rod connected to the top portion of the working cylinder, the hollow piston rod penetrating the first end of the working cylinder, with a first working chamber of the working cylinder being defined between the first end and the top portion and a second working chamber of the working cylinder being defined between the second end and the bottom portion;

a reservoir for a pressure medium;

a shut-off valve with a housing that is coaxially connected to the second end of the working cylinder, the shut-off valve comprising a drainage line connected to the reservoir;

a pressure reservoir connected to the first working chamber for constantly supplying a pressure medium to the first working chamber;

a pressure source comprising an inlet line having a branch connected to the drainage line, the pressure source being connected with the inlet line to the second working chamber for supplying pressure medium to the second working chamber, the pressure medium within the second working chamber being drained via the drainage line of the shut-off valve;

the shut-off valve further comprising a push piston and a means for holding the push piston in its closing position, preferably a spring, the push piston controlling flow of the pressure medium within the inlet line into the second working chamber and into the drainage line;

a drag link with a first and a second end, the first end slidably connected inside the push piston, the drag Link extending through the working piston into the interior of the hollow piston rod, the second end comprising an abutment that comes into a contacting position with the working piston before the working piston reaches the end position of its working stroke, the first end of the drag link comprising an annular abutment, the annular abutment, when the abutment is in the contacting position, moving the push piston in the direction toward its open position until a position of equilibrium is reached in which the working piston is hydraulically held in its end position;

and the shut-off valve further comprising at least one actuating piston that is actuatable by the pressure medium, the actuating piston connected to the push piston for acting on the push piston after termination of the working stroke of the working piston in the direction toward the open position of the push piston so that the push piston is moved from the position of equilibrium to further open the branch to the drainage line such that the pressure of the pressure medium within the second working chamber is reduced and the working piston is moved into its initial position due to the greater pressure in the first working chamber.

Accordingly, the limitation of the working stroke is achieved by the mechanical actuating of a single valve before reaching the predetermined end position by providing a branch within the pressure inlet line and by draining such an amount of pressure medium to the reservoir that the working piston which, on its opposite end, is constantly loaded by the pressure from the pressure reservoir is held in its predetermined end position in a hydraulic manner. It is especially advantageous that the mechanical actuation of the shut-off valve is not constantly activated, but is only activated before reaching the predetermined stroke end position of the working piston. For the answering of the working piston to the shut-off valve, a relatively short distance of the entire working stroke is thus needed. This distance corresponds to the path between the point of contact of the drag link with the working piston to the point where the equilibrated state has been reached, i.e., the point where the push piston has reached a position in which the entire amount of pressure medium pumped by the pressure source is drained via the branch of the inlet line and the drainage line to the reservoir. In this equilibrated state, a hydromechanic positioning control circuit has been established without requiring an external switch or circuit.

The device preferably further comprises a check valve connected between the pressure source and the inlet line, and the pressure source further comprises an outlet line and a controllable pressure limiting valve, whereby the pressure source is connected via the pressure limiting valve to the outlet line.

It is advantageous that the shut-off valve is releasably connected to the working cylinder.

The housing of the shut-off valve has a bore in which the push piston is arranged, the bore having a first and a second annular groove that are axially spaced from one another, with the first annular groove being connected to the branch of the inlet line and with the second annula groove being connected to the drainage line. The push piston has a circumferential groove that, in the closing position of the push piston, communicates only with the second annular groove and, after moving from closing position, communicates with both the first and the second annular grooves. The circumferential groove of the push piston corresponds with its axial length to the axial extension of the two spaced annular grooves. In the initial closed position of the push piston, the first annular groove which is connected to the inlet line, respectively, the branch of the inlet line, is closed by the push piston. After moving from the initial (closed) position, the push piston with its circumferential groove communicates with the previously closed first annular groove so that an increasing amount of pressure medium pumped by the pressure source may be conveyed via the branch of the inlet line, the second annular groove, and the drainage line to the reservoir. Because the drained amount of pressure medium does not increase suddenly, but increases slowly over a certain period of time to the maximum value, a shock-like limiting, respectively, shutting-off of the working stroke of the piston is prevented.

The reciprocation of the working cylinder is achieved by a further reduction of the pressure within the second working chamber at the bottom portion of the piston. For this purpose, the push piston is moved by an external activation, independent of the movement of the working piston, in the direction of further opening of the branch of the inlet line to the reservoir. This may be accomplished by a mechanical actuation or via a hydraulically activated actuating piston. For a hydraulic actuation the housing of the shut-off valve, at a free face thereof, is preferably provided with a projection in which two actuating pistons are arranged via which the push piston may be moved into its open position against the constantly acting holding force. Preferably, the movement of the actuating piston or pistons are controlled by a solenoid.

In order to be able to adjust the point of stroke limitation, it is advantageous to provide the abutment at the second end of the drag link in the form of an adjustable abutment which may be adjusted from the exterior of the device.

An advantageous solution for such an adjustable abutment is provided such that the abutment has an inner thread and the drag link is provided with an outer threaded section, the abutment being threaded onto the threaded section of the drag link. The first end of the drag link extends past the device and is provided with a suitable profiled portion for adjusting the working stroke of the working piston movements. In this embodiment, the abutment itself is secured against rotation within the hollow piston rod; however, it is axially slidable.

DESCRIPTION OF PREFERRED EMBODIMENTS

The present invention will now be described in detail with the aid of several specific embodiments utilizing FIGS. 1 through 3.

The embodiment represented in the drawings is comprised of a hydraulic working cylinder 1 with a working piston 2 in the form of a differential piston to which at the top portion 2*a* a hollow piston rod 3 is connected having its free end closed off. The piston rod 3 ends outside of the hollow working cylinder 1 at the free end 1*a*.

The second end lb of the working cylinder 1 is closed off by an end plate 4 which delimits the working chamber 5 arranged at the bottom portion 2*b* of the working piston 2.

The shut-off valve 7 with its housing 6 is releasably connected to the end plate 4. A push piston 9 is slidably arranged within a boring 8 which is concentric to the cylindrical axis of the working cylinder 1. A return spring 10 acts on the inwardly oriented end face of the push piston 9. FIG. 1 shows the push piston 9 in its closed position in which it contacts an abutment ring 11 with its outer end face.

The push piston 9 is provided with a central bore 12 through which a drag link 13 extends. The drag link 13 furthermore extends through a bore 14 within the working piston 2 into the hollow piston rod 3. An abutment 15 is connected to a threaded section 13.1 of the drag link 13 provided at its second end 13*b*. The abutment 15 is slidable within the longitudinal bore 16 of the piston rod 3; however, it is secured against rotation. Recesses 17 within the mantle surface of the abutment 15 provide a connection between the spaces on either side of the abutment 15.

A support ring 18 is connected to the drag link 13 within the area of the working chamber 5 whereby this support ring contacts, in the initial position, the end plate 4 and thus limits the axial movement of the drag link 13 in a direction counter to the working direction of the piston 2. Furthermore, in the vicinity of the first end 13*a* of the drag link 13, an annular abutment in the form of a follower ring 19 is connected which, upon movement of the drag link 13, comes into contact with the abutment ring 11. The push piston 9 is provided with a circumferential groove 20 which cooperates with the two annular grooves 21, 22 provided at the housing 6. The axial length of the circumferential groove 20 is dimensioned such that in the open position of the push piston 9 both annular grooves 21, 22 are entirely covered (FIG. 3). In the closed position of the push piston 9, the circumferential groove 20 is positioned adjacent to the first annular groove 21 that in this position is closed by the push piston 9.

A projection 23 is connected to the free end face of the housing 6 facing away from the working piston. The projection 23 serves as a housing for, for example, two actuating pistons 24 which due to pressure loading may act on the abutment ring 11. The reference numeral $E_1$ designates a device for indicating the position of the drag link 13. The device $E_1$ sends out a signal when the end portion 25 of the drag link 13 is aligned with it.

A bore 26 is provided for connecting the inlet line $A_1$ of the pressure source 38 to the working chamber 5 for providing pressure medium in order to carry out the working stroke of the working piston 2. A bore 27 is provided to establish a connection to the drainage line T of the reservoir. From the bore 26 one channel extends to the working chamber 5 and a further channel (branch) extends to the annular groove 21. The bore 27 is connected to the annular groove 22. The working cylinder 1 is further provided with a bore 28 for connecting a pressure medium line $P_2$ thereto, whereby a channel extends to the working chamber 29 arranged at the top portion of the piston 2. The projection 23 has a bore 30 for achieving a connection to the line 31 via which the pressure medium for the activation of the activating pistons 24 is supplied.

Further components which are essential for the operation of the hydraulic working cylinder will be described in the following in context with the description of the functioning of the device.

Initial position

The working piston 2 is in its initial position. The push piston 9 of the shut-off valve 7 is in its closed position due to the action of the return spring 10. The working chamber 29 may be loaded with pressure medium from the pressure source 32 via a check valve 33. The feed line $P_2$, behind the check valve 33, is also provided with an adjustable pressure limiting valve 34 and with a valve $Y_2$ to a hydropressure source 35. Further indicated in the drawings are a pressure gauge 36 and safety equipment 37.

After the activation of the valve $Y_2$ the hydropressure source 35 is loaded, for example, to a pressure of 60 bars. This pressure communicates with the working chamber 29 and maintains the working piston 2 in its initial position.

Working stroke (FIG. 1)

A further pressure source 38 is connected via the line $A_1$ to the bore 26 and supplies the pressure medium for the loading of the working chamber 5. A check valve 39 prevents backflow into the line A . A pressure limiting valve $Y_3$ is connected to an outlet line of the pressure source 38. When the valve $Y_3$ is activated by applying voltage, the pressure medium flows from the pressure source 38 into the working chamber 5. Since the shut-off valve 7 is closed, a pressure may build up which causes the displacement of the working piston 2.

The speed of displacement of the working piston 2 depends on the amount of pressure medium supplied by the pressure source 38 while the pressure within the working chamber 5 (without considering external forces) depends on the surface area ratio of the effective piston surface and the operating pressure within the working chamber 29.

Figure 2:
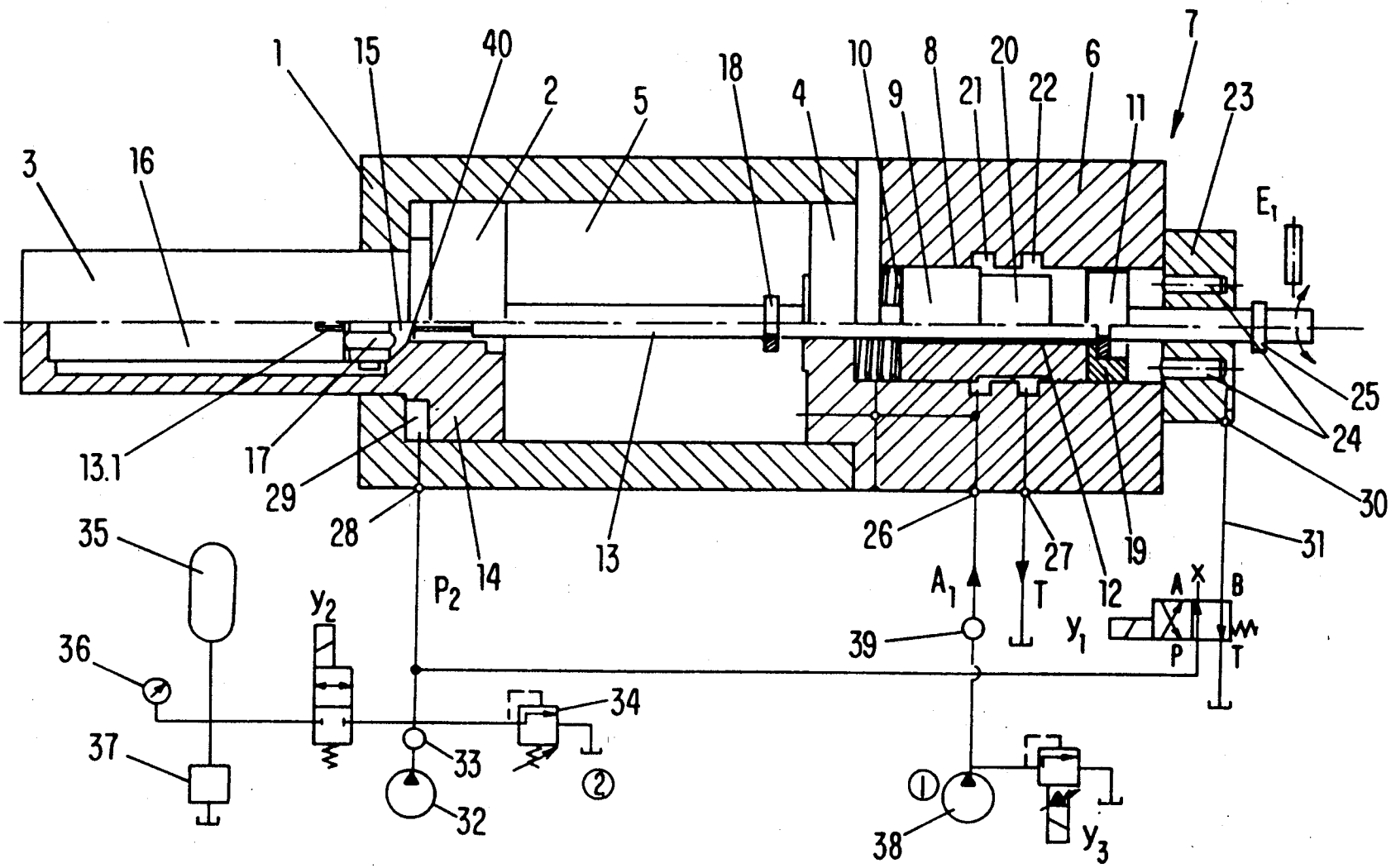
FIG. 2 is a representation corresponding to FIG. 1 in which the working piston is in its shut-off position.

Stroke limitation in the end position (FIG. 2)

When the displaced working piston 2, shortly before reaching its end position, contacts a support surface 40 with an annular abutment 17 (beginning of the mechanical answering), the drag link 13 is now moved and, via this movement and the follower ring 19, the push piston 9 is dragged along in the direction of opening. The circumferential groove 20 is moved into the area of the annular groove 21 and thus provides a connection of the branch of the inlet line $A_1$ to the drainage line T. Accordingly, a portion of the amount of pressure medium provided by the pressure source 38 may be drained into the reservoir. The displacement speed of the working piston 2 is reduced because a defined counter force is acting on the top portion of the working piston 2.

In this manner, a hydromechanical position control circuit results without requiring an external switch or circuit. It is stabilized as follows:

The opening stroke of the push piston 9 is adjusted automatically such that the amount of pressure medium supplied via the inlet line $A_1$ is entirely drained via the line T.

Of course, in the open position of the push piston 9, a change occurs when an external force acts on the piston rod 3, and/or the amount of pressure medium supplied by the pressure source 38 is changed.

However, when nothing is changed, the working piston 2 of the hydraulic working cylinder 1 is equilibrated in this position. The working piston 2 has thus reached the end position of the working stroke without action of a mechanical arresting means.

As soon as the drag link 13 is being dragged by the working piston 2, the device $E_1$ signals this position.

It is obvious from these explanations that the mechanical answering requires only a very small portion of the entire length of the working stroke of the working piston 2. Essentially, this portion corresponds to the overlap of the circumferential groove 20 with the annular groove 21.

Figure 3:
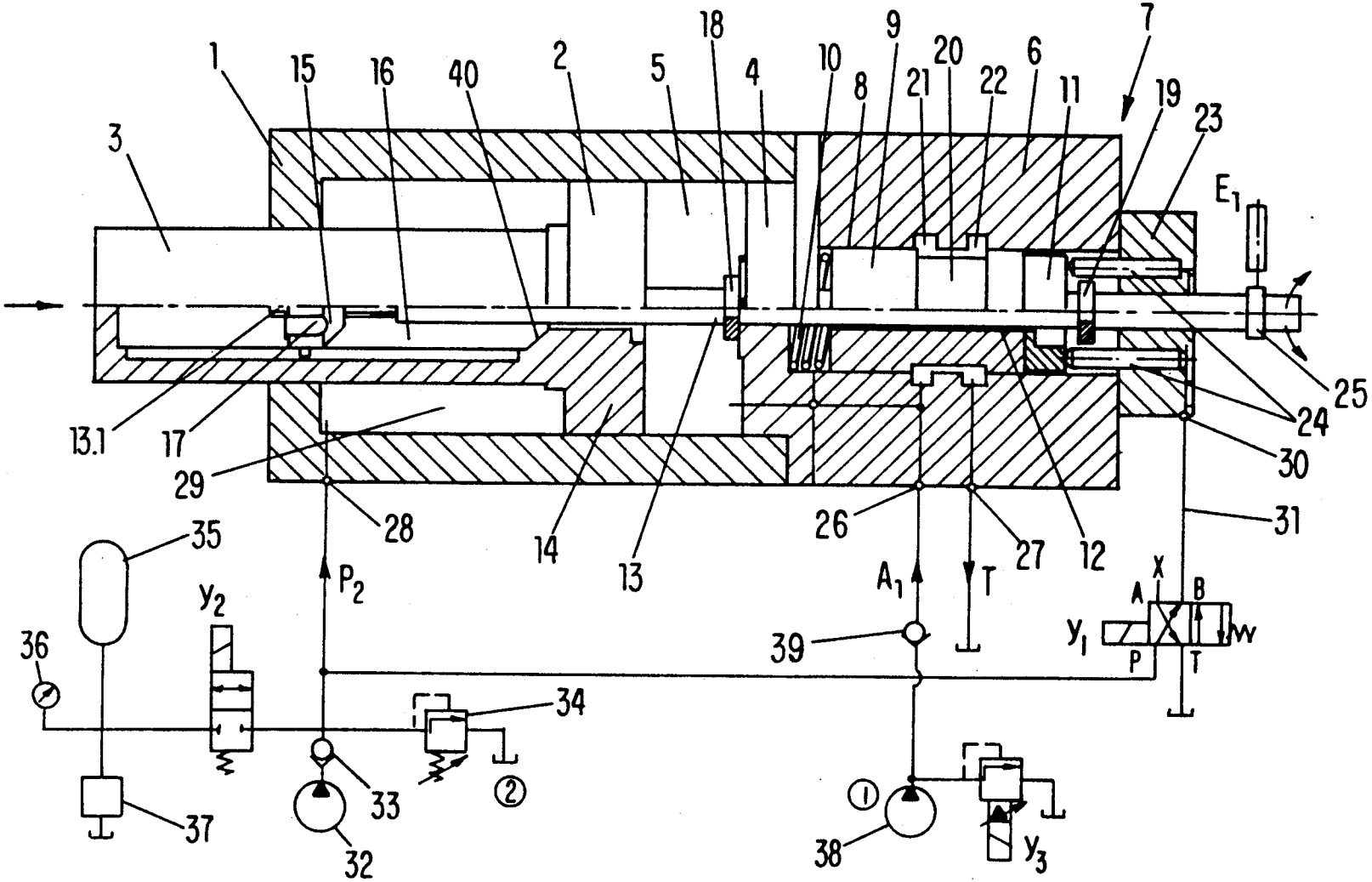
FIG. 3 is a representation corresponding to FIG. 1 in which the working piston is shown during its reciprocal stroke.

Reciprocating stroke (FIG. 3)

The activating pistons 24 are expediently activated by the pressure medium of the pressure source 30. For this purpose, a line 31 is connected via a controllable 4/2-way valve $Y_1$ to the line $P_2$. The drainage lie T of the valve $Y_1$ is connected to the reservoir. The connection A is closed.

When the solenoid $Y_1$ is supplied with voltage, the activating pistons 24 are displaced and the push piston 9 is moved in the direction of further opening from its equilibrated state so that the overlap of the circumferential groove 20 with the annular groove 21 is further increased. Due to the resulting reduction of the throttle function of the shut-off valve 7 the pressure within the working chamber 5 is reduced to such a great extent that due to the greater pressure within the working chamber 29 the working piston is reciprocated into its initial position. For this purpose, the pressure medium which during displacement of the working piston has been stored within the pressure reservoir 35 is used.

During the reciprocating stroke it is of no importance whether the amount of pressure medium supplied by the pressure source 38 is guided via the line $A_1$ or via the controllable pressure limiting valve $Y_3$ to the reservoir.

When the hydraulic cylinder 1 is to be operated constantly, it is suggested that the pressure limiting valve $Y_3$ during operation is not turned off, and the turning point of the working piston 2 is realized solely by the solenoid $Y_1$.

The present invention is, of course, in no way restricted to the specific disclosures of the specification, examples and drawings, but also encompasses any modifications within the scope of the appended claims.

What I claim is:

1. A device for limiting a working stroke of a hydraulic cylinder having a working piston that is actuatable from both ends, said device comprising:

a working cylinder with a first and a second end and a working piston slidably connected within said working cylinder, said working piston having a top portion and a bottom portion and comprising a hollow piston rod connected to said top portion of said working piston, said hollow piston rod penetrating said first end of said working cylinder, with a first working chamber of said working cylinder being defined between said first end and said top portion and a second working chamber of said working cylinder being defined between said second end and said bottom portion;

a reservoir for a pressure medium;

a shut-off valve with a housing that is coaxially connected to said second end of said working cylinder, said shut-off valve comprising a drainage line connected to said reservoir;

a pressure reservoir connected to said first working chamber for constantly supplying a pressure medium to said first working chamber;

a pressure source connected with an inlet line to said second working chamber for supplying the pressure medium to said second working chamber, with the pressure medium within said second working chamber being drained via said drainage line of said shut-off valve;

said shut-off valve further comprising a push piston and a means for holding said push piston in a closed position, said push piston controlling flow of the pressure medium into said drainage line;

a drag link with a first and a second end, said first end slidably connected inside said push piston, said drag link extending through said working piston into the interior of said hollow piston rod, said second end comprising an abutment that comes into a contacting position with said working piston before said working piston reaches the end position of its working stroke, said first end of said drag link comprising an annular abutment, said annular abutment, when said abutment is in said contacting position, moving said push piston in the direction toward an open position until a position of equilibrium is reached in which said working piston is hydraulically held in its end position; and said shut-off valve further comprising at least one actuating piston that is actuatable by the pressure medium, said actuating piston connected to said push piston for acting on said push piston after termination of the working stroke of said working piston in said direction toward the open position so that said push piston is moved from said position of equilibrium to further open said branch to said drainage line such that the pressure of the pressure medium within said second working chamber is reduced and said working piston is moved into its initial position due to the greater pressure in said first working chamber.

2. A device according to claim 1 further comprising a check valve connected between said pressure source and said inlet line, and wherein said pressure source further comprises an outlet line and a controllable pressure limiting valve, said pressure source being connected with said pressure limiting valve to said outlet line.

3. A device according to claim 1, wherein said shut-off valve is detachable from to said working cylinder.

4. A device according to claim 1, wherein said housing of said shut-off valve has a bore in which said push piston is arranged, said bore having a first and a second annular groove that are axially spaced from one another, with said first annular groove being connected to said branch of said inlet line and with said second annular groove being connected to said drainage line, and wherein said push piston has a circumferential groove that in said closing position of said push piston communicates with said second annular groove and after moving from said closing position communicates with said first and said second annular grooves.

5. A device according to claim 1, wherein said shut-off valve further comprises a projection connected to an end face of said housing that is facing away from said working cylinder, with two of said actuating pistons being arranged within said projection for moving said push piston into its open position against the force of said means for holding said push piston in said closing position.

6. A device according to claim 5 wherein for axially adjusting said abutment, said drag link has a threaded section and said abutment has an inner thread, said abutment being threaded onto said threaded section of said drag link, said first end of said drag link extends past said projection and is provided with a profiled section for adjusting the working stroke of the working piston.

7. A device according to claim 1 further comprising a solenoid valve connected to said actuating piston for controlling movement of said actuating piston.

8. A device according to claim 1, wherein said abutment is axially adjustable from the exterior of said device.

9. A device according to claim 1, wherein said means for holding said push piston in its closing position is a spring.

* * * * *